US006638041B2

(12) United States Patent
Yamamoto et al.

(10) Patent No.: US 6,638,041 B2
(45) Date of Patent: Oct. 28, 2003

(54) WATER BASED HYDRAULIC FLUID AND HYDRAULIC PRESSURE DEVICE

(75) Inventors: Hiroshi Yamamoto, Kawasaki (JP); Hiroyuki Tokunaga, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/899,113

(22) Filed: Jul. 6, 2001

(65) Prior Publication Data

US 2002/0006346 A1 Jan. 17, 2002

(30) Foreign Application Priority Data

Jul. 7, 2000 (JP) ..... 2000-206940

(51) Int. Cl.[7] ..... F01C 21/00

(52) U.S. Cl. ..... 418/178; 418/179; 418/206.1; 427/457; 205/261

(58) Field of Search ..... 418/179, 178, 418/206.1; 427/457, 458; 205/261, 291

(56) References Cited

U.S. PATENT DOCUMENTS 563,723 A * 7/1896 Hans ..... 205/261
2,370,108 A * 2/1945 Pike ..... 205/261
2,395,824 A * 3/1946 Herman ..... 418/178
2,966,860 A * 1/1961 Maynard ..... 418/152
3,544,244 A * 12/1970 Haupt ..... 418/178
6,206,667 B1 * 3/2001 Turner, Jr. et al. ..... 418/178

FOREIGN PATENT DOCUMENTS

GB 2149856 * 6/1985 ..... 418/178
JP 56016598 A * 2/1981 ..... C10M/3/02
JP 57-039189 * 3/1982 ..... 205/261
JP 58-045820 * 3/1983 ..... 205/261
JP 60056191 A * 4/1985 ..... 418/178
JP 02-173273 * 7/1990 ..... 205/291

* cited by examiner

*Primary Examiner*—Thomas Denion
*Assistant Examiner*—Theresa Trieu
(74) *Attorney, Agent, or Firm*—Varndell & Varndell, PLLC

(57) ABSTRACT

A subject of the present invention is to provide a water based hydraulic fluid and a hydraulic pressure device able to prevent burning and wearing in a sliding portion of a member constructed by an iron-based material as much as possible. Therefore, the water based hydraulic fluid relative to the invention contains copper ions for forming a film on addendum surfaces of a drive gear and a driven gear constructed by the iron-based material. A gear pump as the hydraulic pressure device relative to the invention uses the water based hydraulic fluid containing metallic ions for forming the film on the addendum surfaces of the drive gear and the driven gear constructed by the iron-based material.

4 Claims, 5 Drawing Sheets

WATER BASED HYDRAULIC FLUID AND HYDRAULIC PRESSURE DEVICE

BACKGROUND OF THE INVENTION

1. Field of the Invention

The present invention relates to a water based hydraulic fluid used in a hydraulic pressure device having a sliding portion of a member constructed by an iron-based material, and a hydraulic pressure device having the sliding portion of the member constructed by the iron-based material and using the water based hydraulic fluid.

2. Description of the Related Art

For example, an hydraulic fluid of a mineral matter oil is normally used conventionally in a system for operating a working machine by the hydraulic fluid supplied by a pump.

However, a using place of the hydraulic fluid of the mineral matter oil is limited since this hydraulic fluid is easily burned. There is also a fear that environment is polluted in leakage of the hydraulic fluid. Further, the hydraulic fluid of the mineral matter oil has high viscosity so that there are disadvantages in that energy loss is caused at operating times of the pump and the working machine.

Therefore, a water based hydraulic fluid such as a water-glycol hydraulic fluid or a water-emulsion hydraulic fluid, etc., is provided in these days as an hydraulic fluid which can solve the above disadvantages.

In the hydraulic pressure device such as the pump, the working machine, etc., each of constructional parts is generally manufactured by an iron-based material, i.e., a material such as carbon steel, chromium steel, etc. in which an alloy element such as carbon, chromium, etc. is contained in iron as a main raw material. However, when the water based hydraulic fluid is used as the hydraulic fluid of these hydraulic pressure devices, an oil film formed in a sliding portion of members such as a supporting portion of a rotating shaft, an engaging portion of a gear, etc. is thin so that the iron-based materials are inevitably burned and worn by metallic contact.

SUMMARY OF THE INVENTION

In consideration of the above actual situation, the present invention is aimed to provide a water based hydraulic fluid and a hydraulic pressure device which can prevent burning and wearing in a sliding portion of a member constructed by an iron-based material as much as possible.

To achieve the above aim, the invention according to a first aspect resides in a water based hydraulic fluid used in a hydraulic pressure device having a sliding portion of a member constructed by an iron-based material, wherein the water based hydraulic fluid contains metallic ions for forming a film on a surface of the member constructed by said iron-based material.

In accordance with the water based hydraulic fluid of the above construction, the film can be formed on the surface of the member constructed by the iron-based material. Accordingly, it is possible to prevent sliding due to metallic contact of the member by this film so that burning and wearing in the sliding portion of this member can be prevented as much as possible.

The invention according to a second aspect resides in a hydraulic pressure device having a sliding portion of a member constructed by an iron-based material and using a water based hydraulic fluid, wherein the water based hydraulic fluid contains metallic ions for forming a film on a surface of the member constructed by said iron-based material.

In accordance with the hydraulic pressure device of the above construction, the film is formed by the water based hydraulic fluid on the surface of the member constructed by the iron-based material. Accordingly, it is possible to prevent sliding due to metallic contact of the member by this film so that burning and wearing in the sliding portion of this member can be prevented as much as possible.

DESCRIPTION OF THE PREFERRED EMBODIMENTS

The present invention will next be explained in detail on the basis of the drawings showing embodiments.

Figure 1:
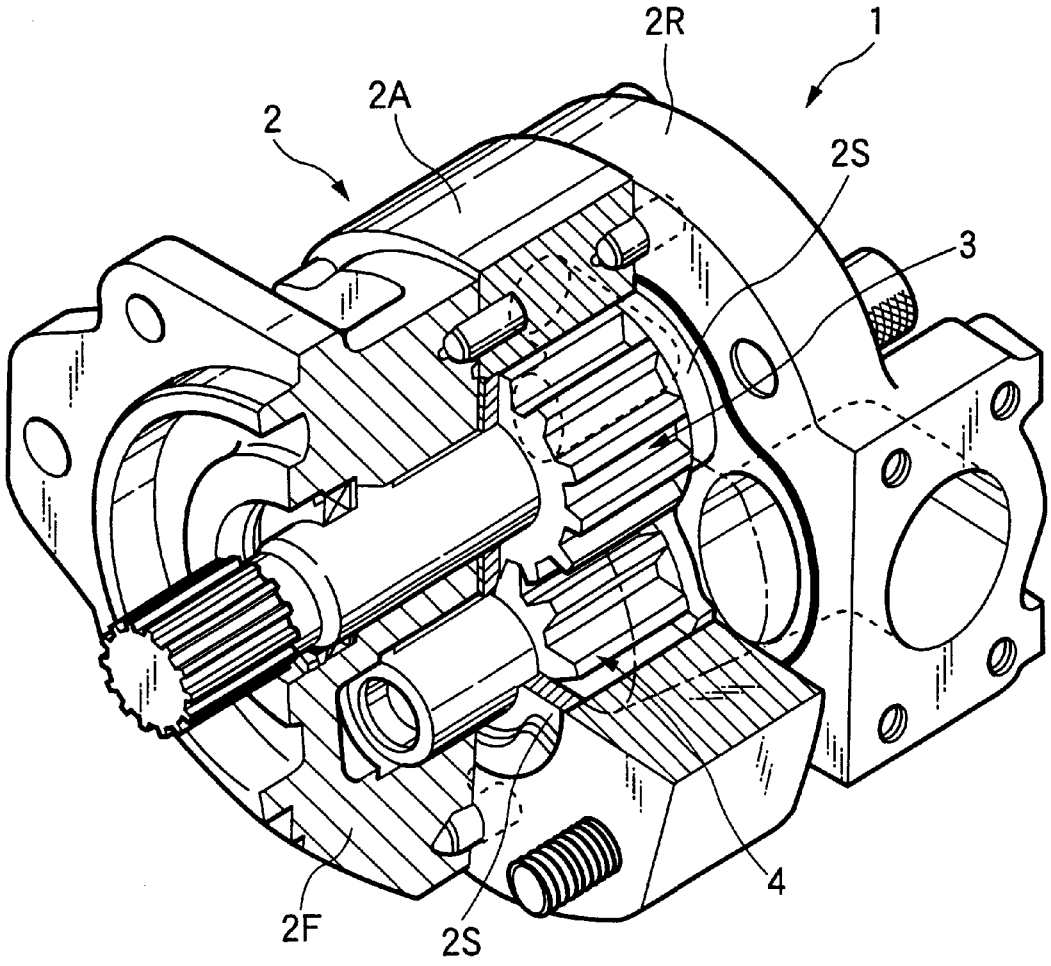
FIG. 1 is a broken perspective view showing a main portion of a hydraulic pressure device in one embodiment of the present invention.

FIG. 1 shows a gear pump as a hydraulic pressure device using a water based hydraulic fluid relative to the invention. As is well known, a drive gear (sliding portion) 3 and a driven gear (sliding portion) 4 engaged with each other are equipped into a casing 2 in the gear pump 1.

In the casing 2, a front cover 2F and a rear cover 2R are assembled into a gear case 2A, and a side plate 2S formed by brass is attached to each of the front cover 2F and the rear cover 2R as a shim with respect to the drive gear 3 and the driven gear 4.

The drive gear 3 and the driven gear 4 are manufactured from chromium molybdenum steel (SCM415H material) as an iron-based material. In this manufacture, cementation, quenching, annealing and shot peening processing (only on a tooth face) are performed after gear cutting processing. Further, a copper plating layer M (see FIG. 3) having about 10 $\mu$m in thickness is formed only in addenda of the drive gear 3 and the driven gear 4.

Figure 2:
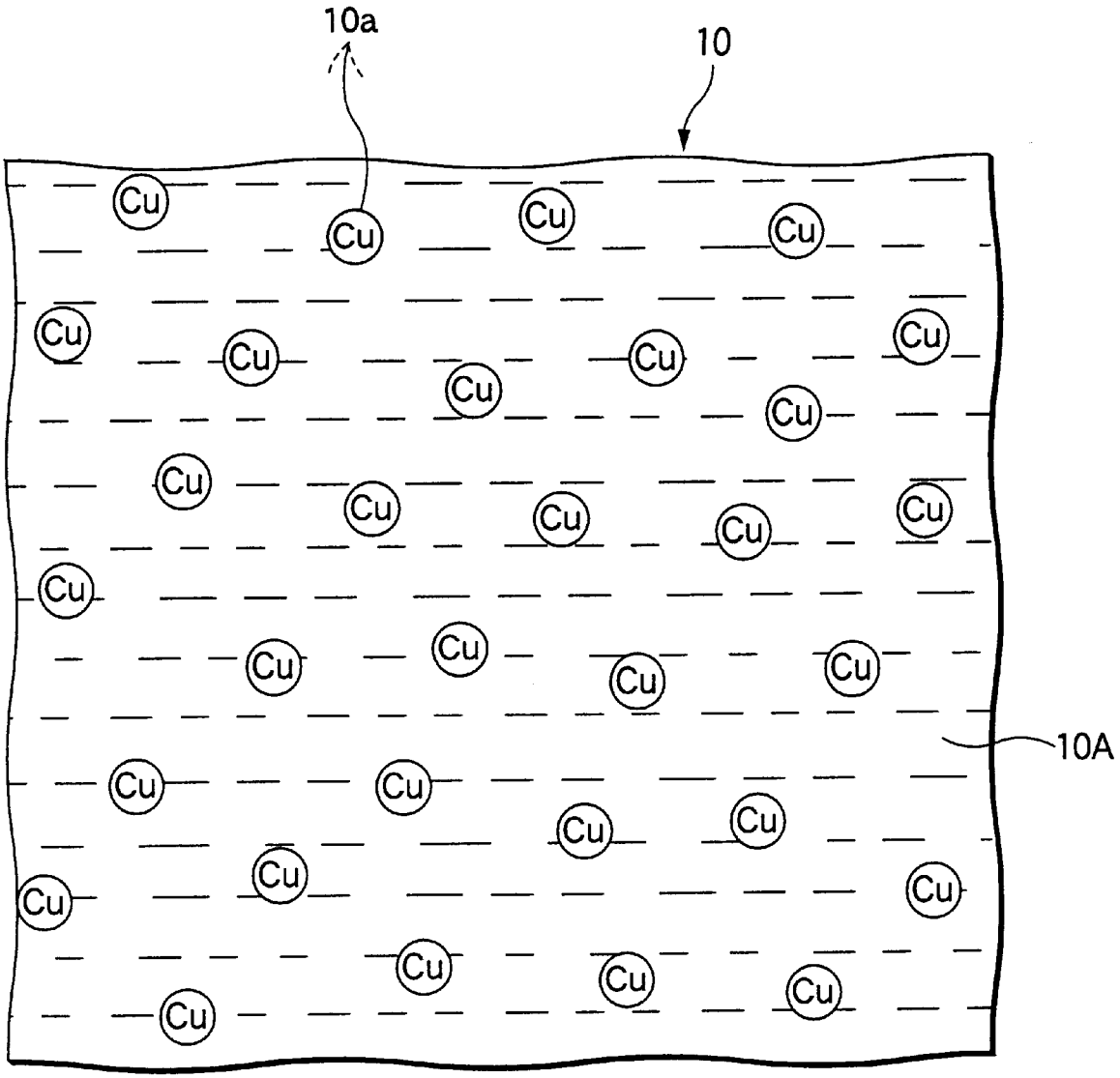
FIG. 2 is a conceptual view showing a water based hydraulic fluid water based hydraulic fluid relative to the invention.

FIG. 2 shows one embodiment of the water based hydraulic fluid relative to the invention and used in the gear pump 1. In this water based hydraulic fluid 10, a water-glycol hydraulic fluid 10A is set as a base, and copper ions (metallic ions) 10*a* are contained in this water-glycol hydraulic fluid 10A.

The copper ions 10*a* in the water based hydraulic fluid 10 are supplied by dissolving copper sulfate ($CuSO_4$) into the water-glycol hydraulic fluid 10A. The water-glycol hydraulic fluid 10A constituting the water based hydraulic fluid 10 is adjusted to pH 10 to pH 11 in alkalinity.

Figure 3A:
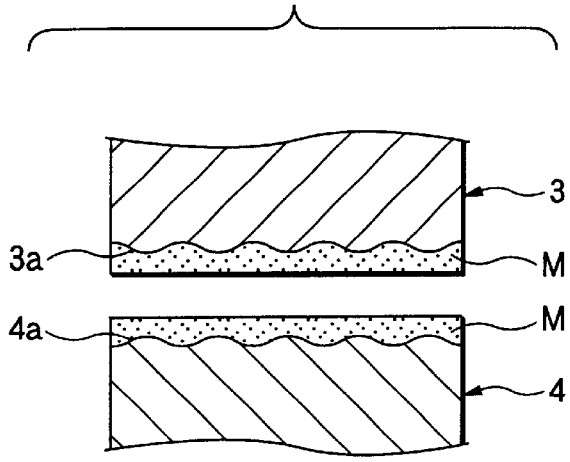
FIGS. 3A, 3B and 3C are conceptual views showing a wearing mode in a sliding portion of the hydraulic pressure device shown in FIG. 1.
Figure 3B:
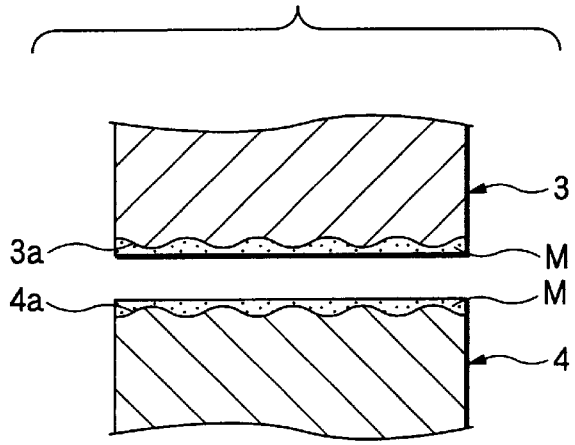

When an operation of the gear pump 1 shown in FIG. 1 is started by using the water based hydraulic fluid 10, the copper plating layer M formed on a surface (addendum) 3*a* of the drive gear 3 and the copper plating layer M formed on a surface (addendum) 4*a* of the driven gear 4 are smoothly worn by mutual rubbing in running-in of the gear pump 1 as shown in FIGS. 3A and 3B.

Thus, a face pressure between the drive gear 3 and the driven gear 4 is extremely reduced and no compound is formed between the copper plating layer M and the iron-based material. Accordingly, generation of disadvantages such as burning, flaking, and pitching is prevented in a sliding portion between the drive gear 3 and the driven gear 4 so that the drive gear 3 and the driven gear 4 are smoothly slid.

Figure 3C:
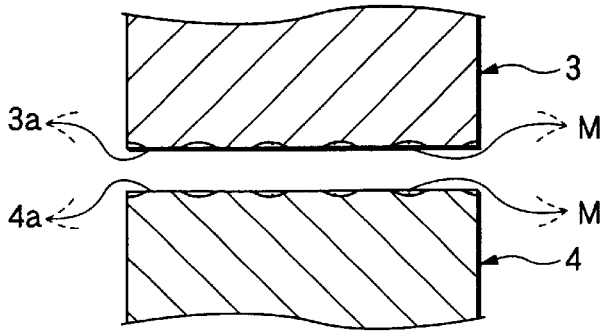

Wearing of the copper plating layer M is advanced as the gear pump 1 is operated. As shown in FIG. 3C, when the surface (addendum) 3*a* of the drive gear 3 is exposed, or when the surface (addendum) 4*a* of the driven gear 4 is exposed, a film C (see FIG. 4) is formed on each of these surfaces 3*a*, 4*a* as described later.

A typical water based hydraulic fluid 10 can include a mixture of ethylene glycol, a water-soluble polymer, and water in a weight ratio of a 40:20:40, respectively (i.e., 40 parts by weight of ethylene glycol, 20 parts by weight of water-soluble polymer, and 40 parts by weight water). Typical water-soluble polymers includes N,N-dimethyl acryamide and other similar polymers.

Figure 4A:
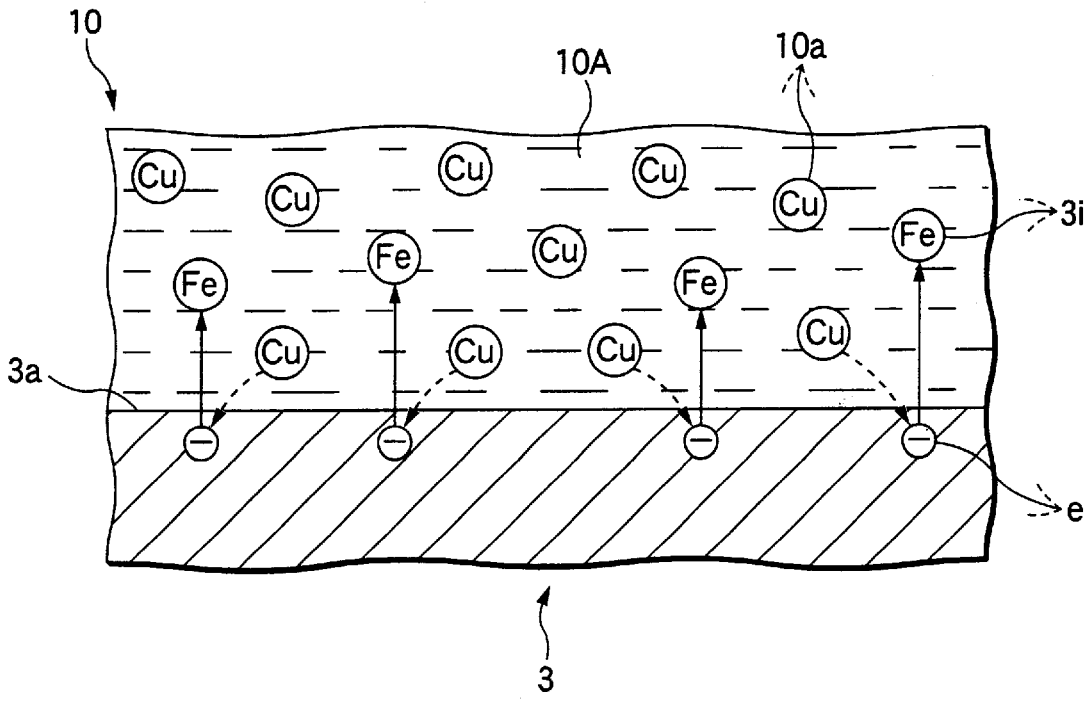
FIGS. 4A and 4B are conceptual views showing a mode in which a film is formed in the sliding portion of the hydraulic pressure device shown in FIG. 1.

The surface 3*a* (a new face appearing by the wearing) of the drive gear 3 exposed by the sliding with respect to the driven gear 4 is active. Therefore, as shown in FIG. 4A, iron ions 3*i*, 3*i*, - - - are eluted into the water based hydraulic fluid 10 from the surface 3*a* of the drive gear 3, and electrons e, e, - - - are left on the surface 3*a* of the drive gear 3.

Figure 4B:
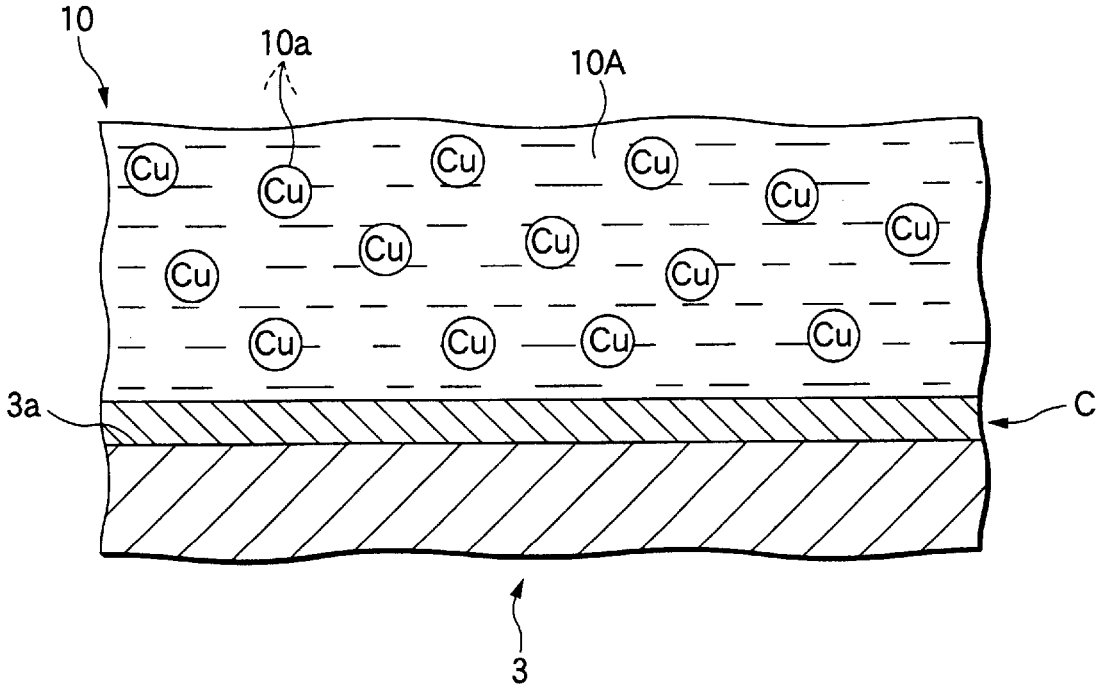

The copper ions 10*i* within the water based hydraulic fluid 10 are coupled to these electrons e, e, - - - , and are deposited by displacement plating. Thus, as shown in FIG. 4B, the film C is formed on the surface 3*a* of the drive gear 3.

As mentioned above, the surface 3*a* of the drive gear 3 is protected by the formation of the film C. Further, even when the film C is chipped off by the sliding, a new film C is formed immediately when the surface 3*a* of the drive gear 3 is exposed. Accordingly, the surface 3*a* of the drive gear 3 is protected by the film C at any time so that the sliding due to metallic contact of the drive gear 3 and the driven gear 4 can be prevented, and generation of burning, etc. can be prevented as much as possible.

Similar to the above case, a film (see FIG. 4) is formed on the surface 4*a* of the driven gear 4, when the surface 3a is slid relative to the drive gear 3. Accordingly, this arrangement prevents generation of burning by this film as much as possible.

Here, a durable test of the gear pump 1 using the water based hydraulic fluid 10 is executed in a condition of hydraulic fluid pressure 210 kg/cm$^2$, gear rotation number 2100 rpm, hydraulic fluid temperature 70° C. In this durable test, no generation of disadvantages such as burning and pitching is recognized even after 400 hours have passed.

In contrast to this, the durable test is executed in the same condition as the above case by using a water-glycol hydraulic fluid adding no copper ions thereto as it is in a gear pump in which no copper plating is formed in addenda of the drive gear and the driven gear. In this durable test, pitching is generated in the addenda of the gears after 100 hours.

As shown in FIG. 3C, when the surface 3*a* of the drive gear 3 or the surface 4*a* of the driven gear 4 is exposed, a face pressure between the drive gear 3 and the driven gear 4 is reduced since the copper plating layer M is formed as mentioned above. Accordingly, generation of burning and cracks is restrained. Therefore, the disadvantages of burning between the drive gear 3 and the driven gear 4 are extremely effectively prevented by forming the film C in addition to this restriction.

The film C, using the displacement plating, is formed by depositing a very small amount of copper ions 10*a*. Accordingly, it is sufficient to use a very small amount of copper ions (metallic components) contained in the water based hydraulic fluid 10. Therefore, no environment is greatly polluted even when the water based hydraulic fluid 10 is leaked.

Here, the amount of the copper ions 10*a* contained in the water based hydraulic fluid 10 can be set to a suitable value in a suitable forming range of the film C on the basis of a condition such as the composition of an iron-based material.

For example, 26.4 mg/l of copper is contained in the said water based hydraulic fluid 10.

The copper ions 10*i* are contained in the water based hydraulic fluid 10 in the above embodiment by dissolving copper sulfate into the water-glycol hydraulic fluid 10A. However, the water based hydraulic fluid 10 relative to the invention can be also formed by eluting copper ions from brass (block, grains, powder, etc.) dipped into the water-glycol hydraulic fluid.

The side plate 2S made of brass is attached to the interior (a flowing area of the water based hydraulic fluid) of the gear pump 1 shown in FIG. 1. Accordingly, when the water-glycol hydraulic fluid 10A is circulated and supplied to the gear pump 1 in a closed circuit including the gear pump 1, the copper ions are eluted from the side plate 2S so that the water based hydraulic fluid 10 of the invention containing the copper ions is supplied to the gear pump 1.

Figure 5:
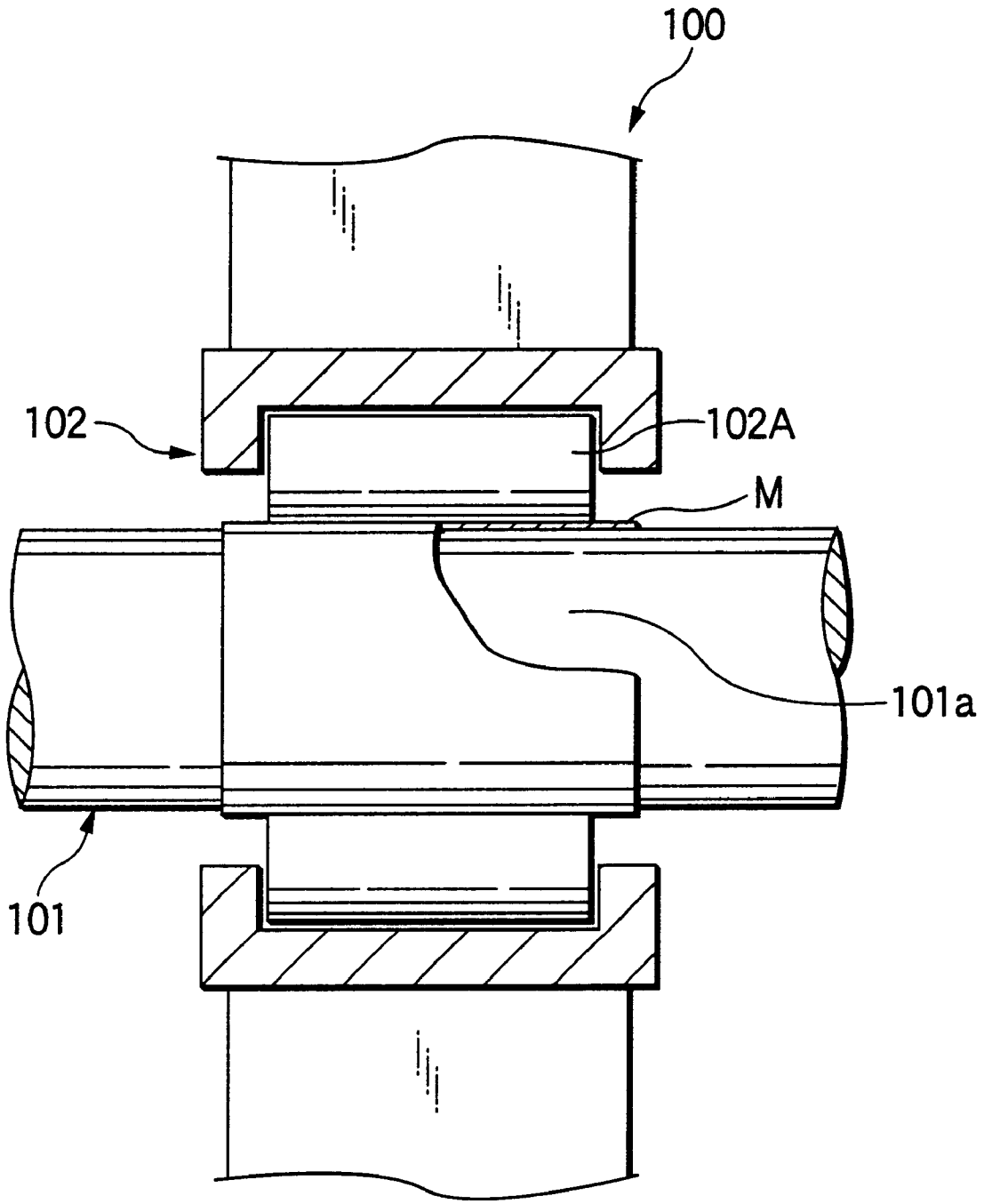
FIG. 5 is a cross-sectional view showing a main portion of a hydraulic pressure device in another embodiment of the invention.

FIG. 5 shows a swash plate pump as the hydraulic pressure device using the water based hydraulic fluid relative to the invention. As is well known, this swash plate pump 100 has a rotating shaft (sliding portion) 101 together with an unillustrated swash plate and a plunger. The rotating shaft 101 is supported by an unillustrated casing through a roller bearing 102.

The rotating shaft 101 is manufactured from chromium molybdenum steel (SCM415H material) as an iron-based material, and cementation, quenching, annealing and shot peening processing are performed. Further, a copper plating layer M having about 5 $\mu$m in thickness is formed on a surface (a rolling surface of the roller) 101*a* of the rotating shaft 101.

In contrast to this, a water based hydraulic fluid 10 is used in swash plate pump 100. This water based hydraulic fluid 10 is the water based hydraulic fluid 10 relative to the invention explained with reference to FIG. 2. Namely, copper ions 10*a* are contained by dissolving copper sulfate into the water-glycol hydraulic fluid 10A, and the water based hydraulic fluid 10 is adjusted to pH 10 to pH 11 in alkalinity.

When the swash plate pump 100 shown in FIG. 2 begins to be operated by using the water based hydraulic fluid 10, the copper plating layer M formed on the surface 101*a* of the rotating shaft 101 is smoothly worn by rubbing this copper plating layer M and a roller 102A of the roller bearing 102 in running-in of the swash plate pump 100.

Thus, a face pressure between the rotating shaft 101 and the roller 102A is extremely reduced. Accordingly, generation of disadvantages such as burning, flaking and pitching is prevented in a sliding portion between the rotating shaft 101 and the roller 102A, and the rotating shaft 101 is smoothly rotated.

When the surface 101*a* of the rotating shaft 101 is exposed by advancing the wearing of the copper plating layer M as the swash plate pump 100 is operated, a film (see reference numeral C in FIG. 4) is formed on the surface 101*a* in the same mode as the previous explanation made with reference to FIG. 4.

The surface 101*a* of the rotating shaft 101 is protected by the formation of the film. Further, even when the film is chipped off by sliding, a new film is formed immediately when the surface 101*a* of the rotating shaft 101 is exposed. Accordingly, the surface 101*a* of the rotating shaft 101 is protected by the film at any time. Therefore, it is possible to prevent the sliding due to metallic contact of the rotating shaft 101 and the roller 102A so that generation of burning can be prevented as much as possible.

Here, a durable test of the swash plate pump 100 using the water based hydraulic fluid 10 is executed in a condition of radial load 750 kgf, rotating number 2500 rpm and hydraulic fluid temperature 95° C. In this durable test, no generation of disadvantages such as flaking and peeling is recognized on the surface 101*a* of the rotating shaft 101 even after 200 hours have passed.

In contrast to this, the durable test is executed in the same condition as the previous case by using a water-glycol hydraulic fluid adding no copper ions thereto as it is in a swash plate pump in which no copper plating layer is formed on the surface of the rotating shaft. In this durable test, flaking and peeling are generated after about 20 hours.

The copper plating layer M is formed in the drive gear 3 and the driven gear 4 of the gear pump 1 shown in FIG. 1, and the rotating shaft 101 of the swash plate pump 100 shown in FIG. 5 so as to reduce the face pressure in respective sliding portions. However, a copper film may be also formed instead of the plating layer by a method such as thermal spraying and sputtering.

Even when no copper plating layer (copper film) is formed, a film is formed on the surface of a member constructed by an iron-based member by the water based hydraulic fluid 10 as mentioned above, and sliding caused by metallic contact of this member is prevented by this film. Accordingly, no copper plating layer (copper film) is necessarily required, but it is very effective to form the copper plating layer (copper film) to further effectively prevent burning in a sliding portion of this member.

In each of the above embodiments, the gear pump and the swash plate pump are exemplified as the hydraulic pressure device. However, the invention can be effectively applied to various hydraulic pressure devices when each of these hydraulic pressure devices has the sliding portion constructed by the iron-based material and uses the water based hydraulic fluid relative to the invention.

For example, the invention can be effectively applied to a hydraulic pressure device using water of a river as the hydraulic fluid so as to open and close a floodgate arranged in the river.

In this case, the water based hydraulic fluid relative to the invention is formed by supplying copper ions by dissolving copper sulfate into water taken out of the river, or supplying the copper ions eluted from brass (block, grains, powder, etc.) arranged in a water taking-out passage, etc.

In the water based hydraulic fluid, copper is adopted as metallic ions for forming the film on a surface of the iron-based material. However, in addition to copper, various kinds of metals such as gold, silver, lead, zinc, cadmium, tin, indium, antimony, bismuth, selenium, tellurium and thallium can be also adopted as a metal (metallic ions) for forming the film on the surface of the iron-based material.

In the water based hydraulic fluid, the copper ions are contained in the water-glycol hydraulic fluid. However, the water based hydraulic fluid relative to the invention can be also constructed by setting a water-emulsion hydraulic fluid or water as a base composition, and containing the copper ions (or the above other metallic ions) in this base composition.

Further, as is well known, no iron-based material is easily rusted under an alkaline condition. Therefore, since the water based hydraulic fluid 10 is adjusted to pH 10 to 11 in alkalinity, the corrosion of a member constructed by the iron-based material is effectively prevented. Accordingly, it is very effective to prevent the corrosion of a member in the hydraulic pressure device particularly used for a long period.

What is claimed is:

1. A hydraulic pressure device having two members made of an iron-based material, the two members respectively having opposing sliding portions that face one another, and a water based hydraulic fluid consisting essentially of a sufficient amount of metallic ions arranged between the sliding portions of the two members for reducing friction between the two sliding portions of the two members during operation of the hydraulic pressure device.

2. A hydraulic pressure device according to claim 1, wherein the metallic ions of the water based hydraulic fluid are copper ions.

3. A hydraulic pressure device according to claim 1, wherein the sliding portions of the two members have a surface layer of copper and the metallic ions of the water based hydraulic fluid are copper ions.

4. A hydraulic pressure device according to claim 1, wherein the water based hydraulic fluid consists essentially of about 26.4 mg/l of copper ions.

* * * * *